US010946881B2

(12) United States Patent
Corbo et al.

(10) Patent No.: US 10,946,881 B2
(45) Date of Patent: Mar. 16, 2021

(54) AUTOMATED TESTING AND REPORTING OF TIMELY ACTIVATION OF CROSSING WARNING EQUIPMENT BASED ON DATA ORIGINATED FROM A REAL-TIME TRAIN TRACKING SYSTEM

(71) Applicant: Siemens Mobility, Inc., New York, NY (US)

(72) Inventors: Mark Corbo, Louisville, KY (US); Stefan Fritschi, Louisville, KY (US); Omer Metel, Anchorage, KY (US)

(73) Assignee: Siemens Mobility, Inc., New York, NY (US)

( * ) Notice: Subject to any disclaimer, the term of this patent is extended or adjusted under 35 U.S.C. 154(b) by 358 days.

(21) Appl. No.: 15/972,335

(22) Filed: May 7, 2018

(65) Prior Publication Data

US 2019/0337543 A1 Nov. 7, 2019

(51) Int. Cl.

| | |
|---|---|
| ***B61L 25/02*** | (2006.01) |
| ***B61L 27/00*** | (2006.01) |
| ***B61L 1/02*** | (2006.01) |
| ***B61L 29/28*** | (2006.01) |

(Continued)

(52) U.S. Cl.

CPC ..... *B61L 27/0077* (2013.01); *B61L 1/02* (2013.01); *B61L 25/021* (2013.01); *B61L 25/023* (2013.01); *B61L 25/025* (2013.01); *B61L 27/0038* (2013.01); *B61L 29/28* (2013.01);

(Continued)

(58) Field of Classification Search

CPC .... B61L 25/021; B61L 25/023; B61L 25/025; B61L 27/00; B61L 27/005; B61L 27/0027; B61L 27/0038; B61L 27/0061; B61L 27/0077; B61L 29/28; B61L 29/30; B61L 29/32

See application file for complete search history.

(56) References Cited

U.S. PATENT DOCUMENTS 5,699,986 A * 12/1997 Welk ..... B61L 29/24 246/122 R 6,241,107 B1 6/2001 Boyer (Continued)

OTHER PUBLICATIONS

Oorni, Risto, Reliability of an in-vehicle warning system for railway level crossings—a user-oriented analysis, IET Intelligent Transport Systems, 2014, pp. 9-20, vol. 8, The Institution of Engineering and Technology, Finland.

(Continued)

*Primary Examiner* — Zachary L Kuhfuss

(57) ABSTRACT

A railroad system including a wayside inspector system responsive to data originated from a real-time train tracking system, such as GPS or PTC is provided. The data from the real-time train tracking system includes data indicative of a respective train en route to a respective crossing. The data is further indicative of a respective direction of travel on a respective railway track of the respective train en route to the respective crossing. Disclosed embodiments offer a technical solution involving no physical sensing devices on the railway tracks for detection of the respective train en route to the respective crossing. This solution is effective for automated testing and reporting of timely activation of crossing warning equipment based on the data originated from the real-time train tracking system.

13 Claims, 4 Drawing Sheets

(51) Int. Cl.
*B61L 29/30* (2006.01)
*B61L 29/32* (2006.01)

(52) U.S. Cl.
CPC ..... *B61L 29/30* (2013.01); *B61L 29/32* (2013.01); *B61L 2205/04* (2013.01)

(56) References Cited

U.S. PATENT DOCUMENTS

| | | | | |
|---|---|---|---|---|
| 7,263,475 | B2 * | 8/2007 | Hawthorne | B61L 3/125 703/8 |
| 8,109,474 | B2 * | 2/2012 | Bartek | B61L 25/021 246/124 |
| 8,509,970 | B2 * | 8/2013 | Kane | B61L 25/025 701/20 |
| 8,725,761 | B2 | 5/2014 | Rout | |
| 9,630,635 | B2 | 4/2017 | Toshack | |
| 10,501,102 | B2 * | 12/2019 | Chung | B61L 27/04 |
| 2008/0169385 | A1 * | 7/2008 | Ashraf | B61L 29/282 246/130 |
| 2013/0256466 | A1 * | 10/2013 | Carlson | B61L 29/30 246/218 |
| 2014/0346284 | A1 * | 11/2014 | Fries | B61L 13/00 246/125 |
| 2014/0365160 | A1 * | 12/2014 | Steffen, II | B61L 27/0055 702/122 |
| 2016/0362123 | A1 * | 12/2016 | Schultz | B61L 27/0038 |
| 2019/0308649 | A1 * | 10/2019 | Harp | B61L 29/224 |
| 2019/0337543 | A1 * | 11/2019 | Corbo | B61L 29/28 |

OTHER PUBLICATIONS

Thurston, David F., Highway Crossing Control Using PTC Technology, Proceedings of the 2013 Joint Rail Conference, Apr. 15-18, 2013, pp. 1-7, Knoxville, Tennessee.

Apta Rail Transit Crossings Working Group, Rail Transit Grade Crossing Warning Device Inspection, Testing and Maintenance, APTA Standards Development Program, Jan. 31, 2017, pp. 1-18, Washington, DC.

* cited by examiner

AUTOMATED TESTING AND REPORTING OF TIMELY ACTIVATION OF CROSSING WARNING EQUIPMENT BASED ON DATA ORIGINATED FROM A REAL-TIME TRAIN TRACKING SYSTEM

BACKGROUND

1. Field

Disclosed embodiments are generally related to a railroad system and, more particularly, to a railroad system effective for automated testing and reporting of timely activation of crossing warning equipment based on data originated from a real-time train tracking system, as may involve onboard train equipment.

2. Description of the Related Art

A constant warning time device (often referred to as a crossing predictor or a grade crossing predictor in the U.S., or a level crossing predictor in the U.K.) is an electronic device that may be electrically connected to the rails of a railway track and is configured to detect the presence of a train en route to a crossing and determine train speed and distance to the crossing (a location at which the railway track intersect a road, sidewalk or other surface used by moving bodies).

The constant warning time device uses this detection information to generate a constant warning time signal for controlling crossing warning equipment. This is equipment that warns of the approach of a train at the crossing, examples of which include crossing gate arms (e.g., the familiar black and white striped wooden arms often found at highway grade crossings to warn motorists of an approaching train), crossing lights (such as the red flashing lights often found at highway grade crossings in conjunction with the crossing gate arms discussed above), and/or crossing bells or other audio alarm devices. Constant warning time devices may be (but not always) configured to activate the crossing warning device at approximately a fixed target time (e.g., target time (seconds)±certain predefined tolerance (seconds)) prior to an approaching train arriving at the crossing.

In the US, the Federal Railroad Administration (FRA) mandates that a constant warning time device be capable of detecting the presence of a train as it approaches a crossing and to activate the crossing warning equipment in a timely manner that is suitable for the train speed and distance to the crossing. In addition, the device must be capable of detecting trains that approach the crossing from multiple possible directions to the crossing (e.g., from east to west and from west to east, north to south and south to north, etc.). That is, every possible track (e.g., every possible physical route or path) through the crossing.

Consistent with such a mandate, the FRA has issued regulations requiring various testing (e.g., periodic testing, such as monthly, quarterly or annual basis) regarding appropriate operation of the crossing warning equipment. One of these FRA-mandated tests is an annual warning time test, commonly requiring personnel of a railroad organization responsible for a given crossing to physically run or simulate train movement from all appropriate directions and possible tracks at the given crossing. The results of this testing must be submitted to the FRA. This can be a substantial burden and expense to a railroad organization because, for example, this testing is time consuming and, in certain circumstances, may require allocation of some railway vehicles to verify possible routes and respective warning times that may be associated with a given crossing. The burden and expense may be exacerbated in crossings involving more complex crossing warning devices, such as may involve switches for selectively interconnecting multiple routes. U.S. Pat. No. 9,630,635 describes system and techniques involving a wayside inspector system that uses physical sensing devices (e.g., magnetometers) installed on the railway tracks to wirelessly detect the presence of a train, and its direction along a given railway track. This patent is herein incorporated by reference in its entirety.

BRIEF DESCRIPTION

One disclosed embodiment is directed to a railroad system including a wayside inspector system responsive to data originated from a real-time train tracking system, as may include onboard train equipment. The data from the real-time train tracking system includes data indicative of a respective train en route to a respective crossing. The data is further indicative of a respective direction of travel on a respective railway track of the respective train en route to the respective crossing.

The wayside inspector system in turn may include a processor configured to process the data indicative of the respective train en route to the respective crossing. The processor may include a timer configured to measure a time elapsed from activation of crossing warning equipment prior to arrival of the respective train en route to the respective crossing to a time of arrival of the respective train to the respective crossing, and a memory to store a data set configured by the processor to uniquely associate the measured elapsed time with the respective crossing including the respective direction of travel on the respective railway track of the respective train en route to the respective crossing.

DETAILED DESCRIPTION

Figure 1:
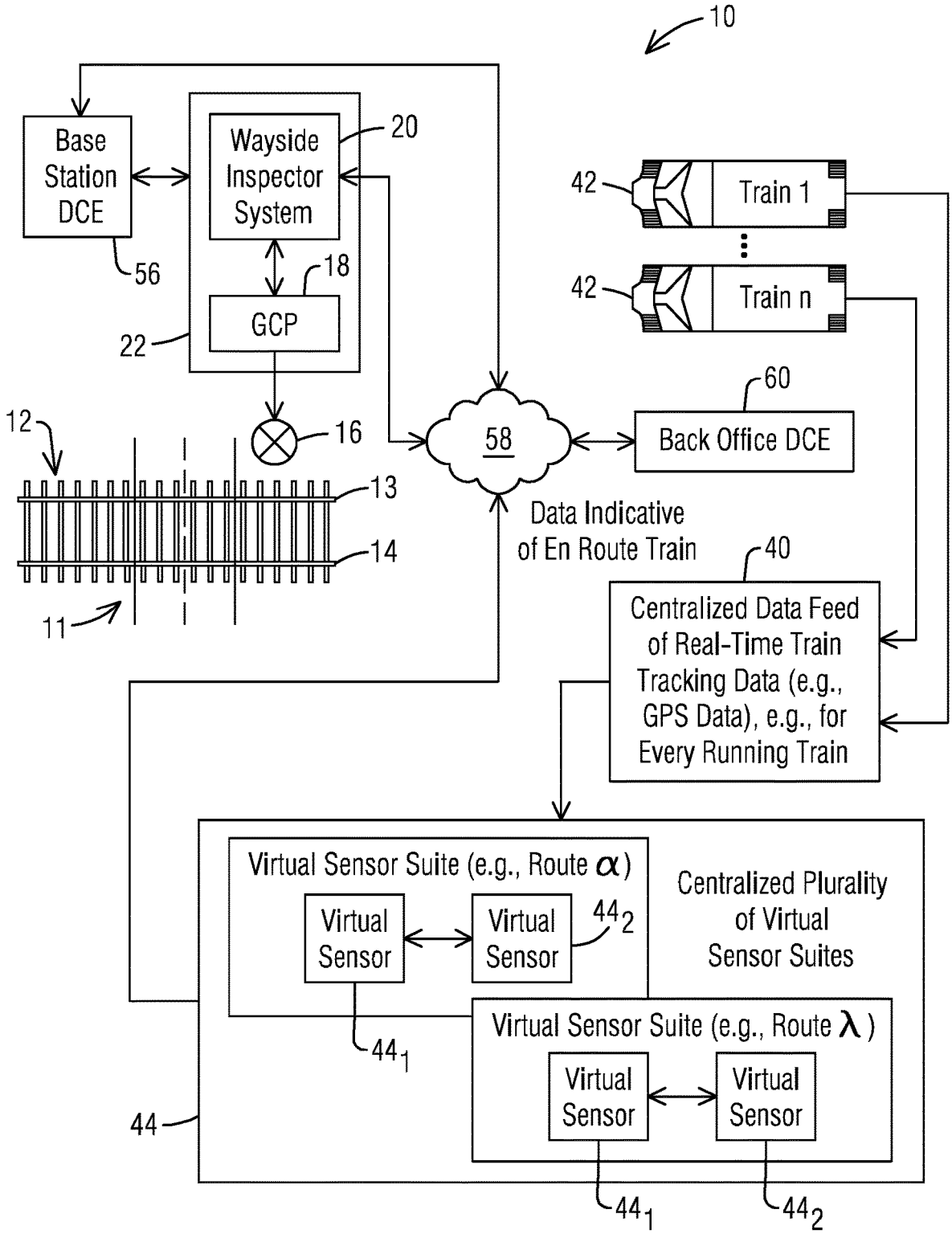
FIG. 1 is a schematic of a railroad system embodying disclosed concepts, as may involve a centralized plurality of virtual sensor suites in communication with a centralized data feed of a Global Navigation Satellite System (GNSS), such as may comprise global positing system (GPS) train tracking data, as may be used in certain disclosed embodiments for automated testing of timely activation of crossing warning equipment.

The inventors of the present invention have recognized some practical considerations that may arise regarding a known system involving physical sensing devices, such as magnetometers, installed on railway tracks to detect the presence of a train, and its direction along a given track through a respective crossing. For instance, railroad organizations may deal with budgetary constraints that may impede deployment (rapid deployment or otherwise) of such physical sensing devices over a large railroad network that may involve tens of thousands or more of crossings. Moreover, presuming that a railroad organization can clear such budgetary constraints, in the long run the railroad organization still must deal with the substantial cost and effort that may be involved for maintaining the deployed sensing devices over a large railroad network.

In view of such recognition, the present inventors propose an innovative technical solution involving no physical sensing devices on the railway tracks. The proposed technical solution makes effective use of data originated from a real-time train tracking system, as may involve a Global Navigation Satellite System (GNSS), such as global positing system (GPS); or a positive train control system (PTC). Each of such train tracking systems may involve onboard train equipment. As will be appreciated by one skilled in the art, these systems have or will shortly become ubiquitous in the railroad industry, and, consequently, the railroad industry should welcome technical solutions that utilize data from such systems to increase operating efficiency into other areas beyond their original scope. It will be appreciated that GPS is one non-limiting example of a GNSS that provide autonomous geo-spatial positioning with global coverage. Other examples of a GNSS may be GLONASS, Galileo, Beidou and other regional systems.

In the following detailed description, various specific details are set forth in order to provide a thorough understanding of such embodiments. However, those skilled in the art will understand that disclosed embodiments may be practiced without these specific details that the aspects of the present invention are not limited to the disclosed embodiments, and that aspects of the present invention may be practiced in a variety of alternative embodiments. In other instances, methods, procedures, and components, which would be well-understood by one skilled in the art have not been described in detail to avoid unnecessary and burdensome explanation.

Furthermore, various operations may be described as multiple discrete steps performed in a manner that is helpful for understanding embodiments of the present invention. However, the order of description should not be construed as to imply that these operations need be performed in the order they are presented, nor that they are even order dependent, unless otherwise indicated.

Moreover, repeated usage of the phrase "in one embodiment" does not necessarily refer to the same embodiment, although it may. It is noted that disclosed embodiments need not be construed as mutually exclusive embodiments, since aspects of such disclosed embodiments may be appropriately combined by one skilled in the art depending on the needs of a given application.

The terms "comprising", "including", "having", and the like, as used in the present application, are intended to be synonymous unless otherwise indicated. Lastly, as used herein, the phrases "configured to" or "arranged to" embrace the concept that the feature preceding the phrases "configured to" or "arranged to" is intentionally and specifically designed or made to act or function in a specific way and should not be construed to mean that the feature just has a capability or suitability to act or function in the specified way, unless so indicated.

FIG. 1 is a schematic of a railroad system 10 embodying disclosed concepts, as may involve without limitation, a centralized plurality of virtual sensor suites in communication with a centralized data feed of a Global Navigation Satellite System (GNSS), such as may comprise global positing system (GPS) train tracking data used in certain disclosed embodiments for automated testing of timely activation of crossing warning equipment.

As will be appreciated by those skilled in the art, railroad system 10 may be used in connection with a plurality of road crossings, as exemplified by road crossing 11, which may hereinafter be simply referred to as "a crossing". Crossing 11 intersects a portion of a railway track 12, such as may be made up of a pair of track rails 13 and 14. For the sake of simplicity of illustration, the figures illustrate just a singular railroad track disposed perpendicular relative to the crossing. It should be appreciated that disclosed embodiments are not limited to singular railway tracks, or to any particular geometric arrangement between the railway track and the crossing.

In one non-limiting embodiment, crossing warning equipment 16 may be controlled by a grade crossing predictor (GCP) 18, which is designed to function as a constant warning time device that determines an approaching train's speed and distance to the crossing, and generates constant warning time signals received by activation circuitry within GCP 18 to activate crossing warning equipment 16, as may include bells, lights, crossing gate arms, etc.

As noted above and without limiting disclosed embodiments to any particular jurisdiction, FRA regulations mandate that crossing warning equipment 16 be activated no later than a pre-determined period of time (prescribed by the regulations) before the train reaches the crossing. As further noted above, the FRA requires testing and reporting to ensure that the regulations are systematically being adhered to.

In one non-limiting embodiment, railroad system 10 includes a wayside inspector system 20 responsive to data originated from a real-time train tracking system, as may include onboard train equipment. Without limitation, data received by wayside inspector system 20 comprises data indicative of a respective train en route (e.g., on its way) to a respective crossing (e.g., a crossing physically traversed by a respective railway track, such as a respective railway track of route $\alpha$, etc.) Data received by wayside inspector system 20 is further indicative of a respective direction of travel on the respective railway track of the respective train en route to the respective crossing. Non-limiting examples of train tracking systems that may be used in disclosed embodiments may be a GNSS, such as GPS and a PTC system. Without limitation, GCP 18 and/or wayside inspector system 20 may be contained within a housing 22, such as a wayside equipment cage, bungalow or any other suitable structure, as may be located alongside railway track 12.

Figure 4:
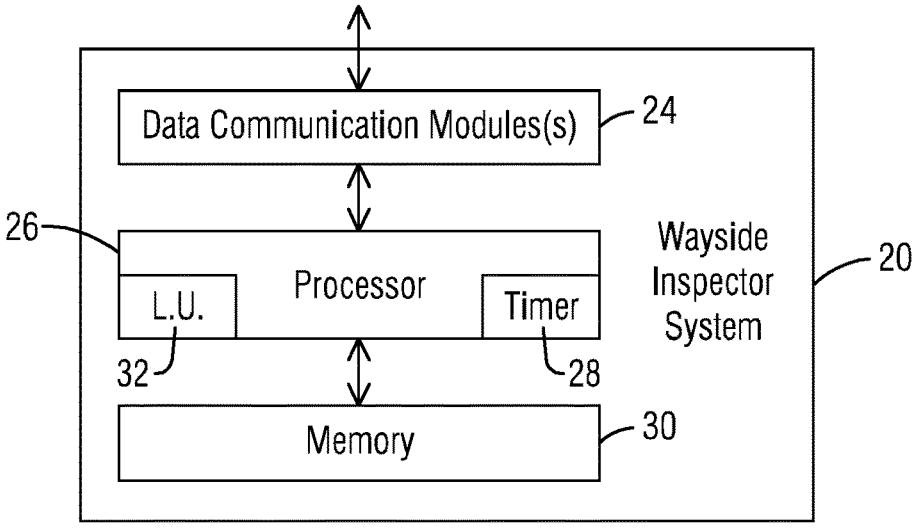
FIG. 4 is a top-level block diagram of one nonlimiting embodiment of a wayside inspector system, as may be used in disclosed embodiments for automated testing and reporting of timely activation of crossing warning equipment.

As shown in FIG. 4, in one non-limiting embodiment, wayside inspector system 20 may include one or more data communication modules 24 that may be used to receive or transmit various data, as will be elaborated in greater detail below. Wayside inspector system 20 may further include a processor 26 configured to process the data indicative of the respective train en route to the respective crossing. Without limitation, processor 26 may include a timer 28 configured to measure a time elapsed from activation of crossing warning equipment 16 prior to arrival of the respective train en route to the respective crossing to a time of arrival of the respective train to the respective crossing. A memory 30 may be used to store a data set configured by processor 26 to uniquely associate the measured elapsed time with the respective crossing including the respective direction of travel on the respective railway track of the respective train en route to the respective crossing.

Returning to FIG. 1, in one non-limiting embodiment, the real-time train tracking system may comprise a global positioning system (GPS) and the data originated from the train tracking system may be obtained from a centralized data feed 40 of GPS train tracking data of a plurality of trains 42 (e.g., labelled Train 1 through Train n) traveling over a railroad network of railway tracks. For example, this could be all running trains of a fleet of trains.

As further illustrated in FIG. 1, in one non-limiting embodiment, a centralized plurality of virtual sensor suites 44 may be in communication with centralized data feed 40 of GPS train tracking data. One of the virtual sensor suites (e.g., virtual suite labelled Route α) of the centralized plurality of virtual sensor suites 44 may be configured to generate the data indicative of the respective train en route to the respective crossing (e.g., the respective crossing associated with the railway track of Route α). That is, this virtual sensor suite would behave analogous to physical sensors (e.g., magnetometers) installed on the railway track on route α for detecting train presence, including the respective direction of travel on the respective railway track of the respective train en route to the respective crossing.

Further ones of the centralized plurality of virtual sensor suites 44 may be respectively configured to generate further data indicative of further respective trains en route to further respective crossings. For example, virtual suite labelled Route λ may be configured to generate data indicative of a further respective train en route to a further respective crossing (e.g., a respective crossing associated with a railway track on route λ). That is, this virtual sensor suite would behave analogous to physical sensors (e.g., magnetometers) installed on the railway track on route λ for detecting train presence including the respective direction of travel on the respective railway track of the respective train en route to the respective crossing. Without limitation, the centralized plurality of virtual sensor suites may (but need not) comprise a cloud-based server.

Without limitation, each respective sensor suite of the centralized plurality of virtual sensor suites 44 may comprise at least two respective virtual sensors $\mathbf{44}_1$, $\mathbf{44}_2$. By way of example, virtual sensors $\mathbf{44}_1$, $\mathbf{44}_2$ may be configured to provide a redundant validity check to the data generated by each respective sensor suite. For example, virtual sensor $\mathbf{44}_1$ may correspond to a given first physical location and provide a first snapshot of train tracking data corresponding to the first physical location. Similarly, virtual sensor $\mathbf{44}_2$ may correspond to a given second physical location, which is defined relative to the first physical location and may provide a second snapshot of train tracking data corresponding to the second physical location. By straightforward motion calculations, the first and second snapshots of train tracking data would be able to provide a redundant validity check to the data generated by each respective sensor suite.

Detection of the presence of the train en route to the respective crossing may be reported to wayside inspector system 20 via a base station data communication equipment (DCE) 56, such as may comprise a computerized system, which in turn is in communication with centralized plurality of virtual sensor suites 44 via a communications network 58 (e.g., the Internet). In one non-limiting embodiment, base station DCE 56 may be proximate to housing 22, and thus a connection between base station DCE 56 and wayside inspector system 20 can be a wired connection, a wireless connection, or both.

In one non-limiting embodiment, processor 26 (FIG. 4) of wayside inspector system 20, based on the data originated from the real-time tracking system, may be configured to determine a speed of travel of the respective train en route to the respective crossing. For example, when the speed of travel is at or above a certain threshold speed value, and the measured elapsed time is at or within a predefined tolerance of a threshold warning time value, then the data set may be flagged or otherwise identified as a data set meeting a warning time requirement associated with the respective direction of travel on the respective railway track for the respective train en route to the respective crossing. Processor 26 may be further configured to associate a date and time indicative of when the measured elapsed time was obtained.

Railroad system 10 may further include back office DCE 60 (e.g., a computerized system) that communicates with wayside inspector system 20 via communications network 58 to receive data sets stored in memory 30 of wayside inspector system 20. In one non-limiting embodiment, back office DCE 60 may be configured to automatically report to a regulation administration (e.g., the FRA) data sets meeting the warning time requirement.

For example, in situations when the speed of travel of the respective train en route to the respective crossing is at or above the certain threshold speed value, and the measured elapsed time is outside the tolerance of the threshold warning time value, then the data set may flagged or otherwise identified as a data set not meeting the warning time requirement associated with the respective direction of travel on the respective railway track for the respective train en route to the respective crossing. In this case, back office communication equipment 60 may be configured to automatically report to a designated party ((e.g., a given railroad organization responsible for the respective crossing) data sets not meeting the warning time requirement to, for example, take appropriate corrective action in connection with the crossing warning equipment.

As shown in FIG. 4, wayside inspector system may further include a logic unit 32 that may be configured to determine whether or not a measurement of time elapsed is to be performed. That is, a measurement of time elapsed from activation of crossing warning equipment prior to arrival of the respective train en route to the respective railroad crossing to a time of arrival of the respective train to the respective railroad crossing.

In a first example scenario, when the speed of travel of the respective train en route to the respective crossing is below a certain minimum speed value, then the measurement of time elapsed should not be performed.

In a second example scenario, if a data set stored in memory 30 indicates 1) a data set meeting a warning time requirement associated with the respective direction of travel on the respective railway track for the respective train en route to the respective railroad crossing; and 2) the data set is less than one year old, and a data log of repairs or changes for the GCP indicates A) no repairs or changes made to the GCP, then then the measurement of time elapsed should not be performed.

In a third example scenario, presuming same second example scenario regarding entries 1) and 2); but if entry A) indicates repairs or changes made to the GCP, then then the measurement of time elapsed should be performed. As should be now appreciated by one skilled in the art, logic unit 32 can be configured with an appropriate level of decision selectivity for implementing or not implementing the testing of activation of crossing warning equipment. The idea is to efficiently and smartly collect test data as necessary to appropriately fulfill the applicable regulations. Conversely, the idea is not to collect test data under conditions that do not fulfill applicable prerequisites to qualify for the test.

Figure 2:
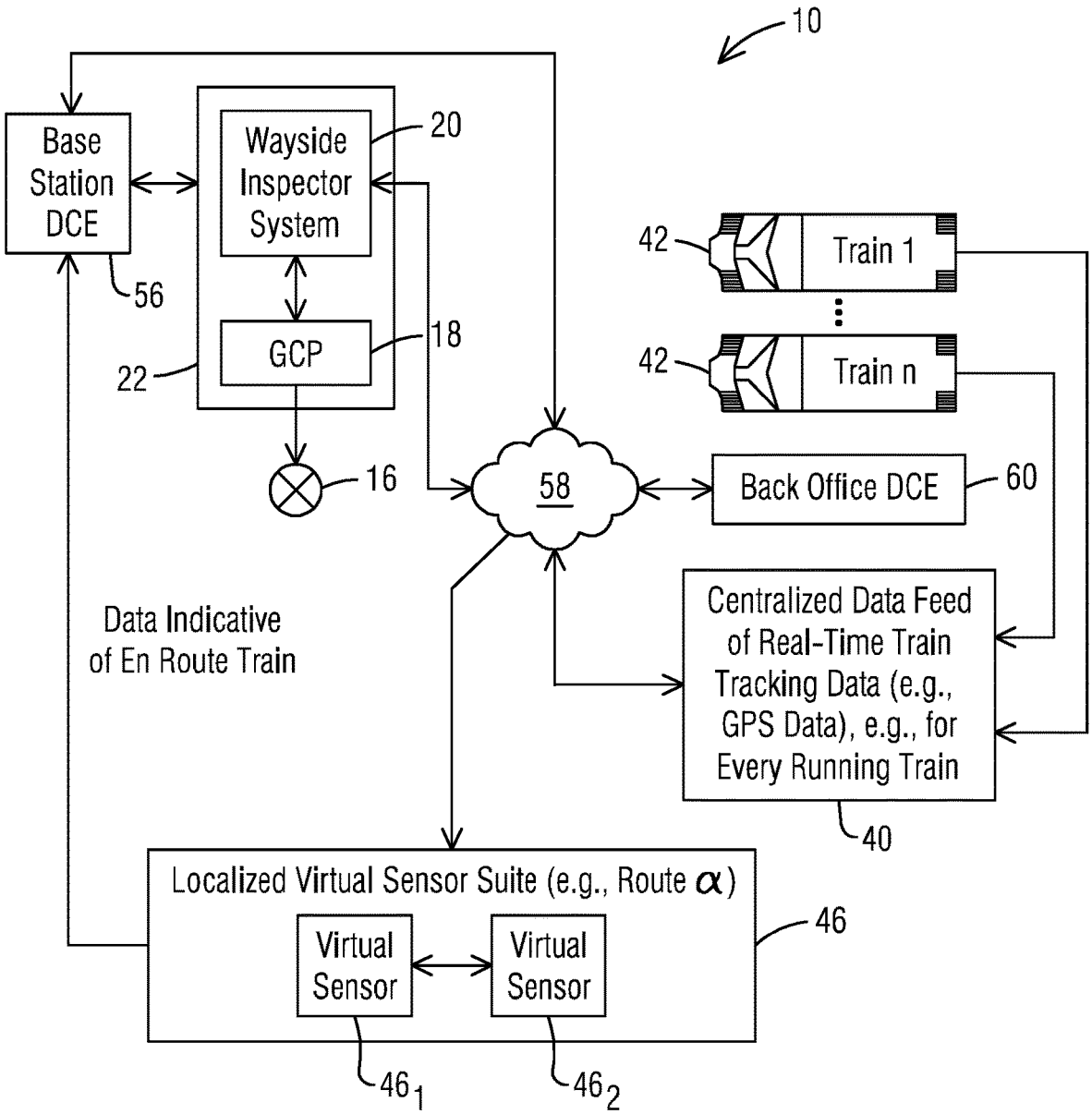
FIG. 2 is a schematic of a railroad system embodying further disclosed concepts, as may involve a plurality of respectively localized virtual sensor suites in communication with the centralized data feed of GPS train tracking data, as may be alternatively used in further disclosed embodiments for automated testing of timely activation of crossing warning equipment.

FIG. 2 is a schematic of a railroad system embodying further disclosed concepts, as may involve a plurality of respectively localized virtual sensor suites in communication with centralized data feed of GPS train tracking data (40), as may be alternatively used in further disclosed embodiments for automated testing of activation of crossing warning equipment.

In this embodiment, in lieu of the centralized plurality of virtual sensor suites 44 (FIG. 1), a plurality of respective localized virtual sensor suites is in communication with the centralized data feed of GPS train tracking data. For simplicity of description just one of the plurality of respective localized virtual sensor suites is illustrated in FIG. 2. For example, one of the virtual sensor suites (e.g., localized virtual suite 46, labelled Route α) of the plurality of respective localized virtual sensor suites may be configured to generate the data indicative of the respective train en route to the respective crossing (e.g., the respective crossing associated with the railway track of Route α). That is, this localized virtual sensor suite would behave analogous to physical sensors (e.g., magnetometers) installed on the railway track on route α for detecting train presence, including the respective direction of travel on the respective railway track of the respective train en route to the respective crossing.

Further ones (not shown in the figure) of the plurality of respective localized virtual sensor suites are respectively configured to generate further data indicative of further respective trains en route to further respective railroad crossings. That is, further localized virtual sensor suites would be arranged for train detection in connection with further crossings. The functionality of further blocks numbered the same in FIG. 2 as in FIG. 1 is the same as described in the context of FIG. 1 and for the sake of avoiding burdensome and pedantic repetition the reader will be spared from such repetition.

Figure 3:
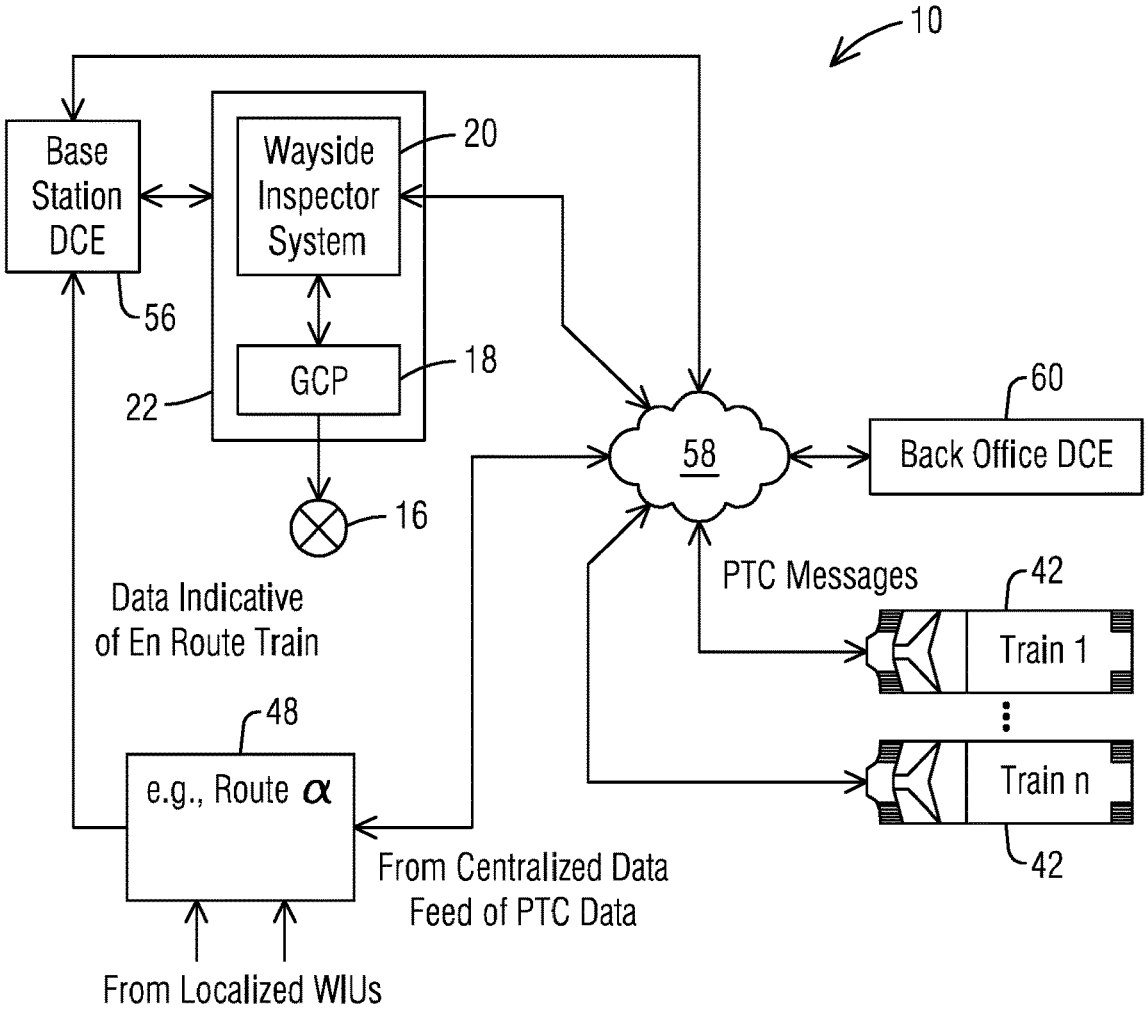
FIG. 3 is a schematic of a railroad system embodying still further disclosed concepts, as may involve messages from a positive train control system (PTC), as may be alternatively used in still further disclosed embodiments for automated testing of timely activation of crossing warning equipment.

FIG. 3 is a schematic of a railroad system embodying still further disclosed concepts, as may involve messages from a positive train control system (PTC), as may be alternatively used in still further disclosed embodiments for automated testing of activation of crossing warning equipment.

In this embodiment, because of the resilient redundancies built-in throughout the PTC system, the concept described above in connection with FIGS. 1 and 2 of virtual sensor suites for performing redundant validity checks is not believed to be necessary and thus this concept is not utilized in this implementation.

In this embodiment, as shown in block 48 appropriate PTC messages either from a centralized data feed of PTC train tracking data of a plurality of trains traveling over a railroad network of railway tracks; or from localized wayside interface units, such as without limitation a signal crossing or a switch location, may be used to convey to wayside inspector system 20 the data indicative of a respective train en route to a respective railroad crossing, which is also indicative of a respective direction of travel on a respective railway track of the respective train en route to the respective railroad crossing. The functionality of further blocks numbered the same in FIG. 3 as in FIG. 1 is the same as described in the context of FIG. 1 and the reader once again will be spared from such repetition.

Figure 5:
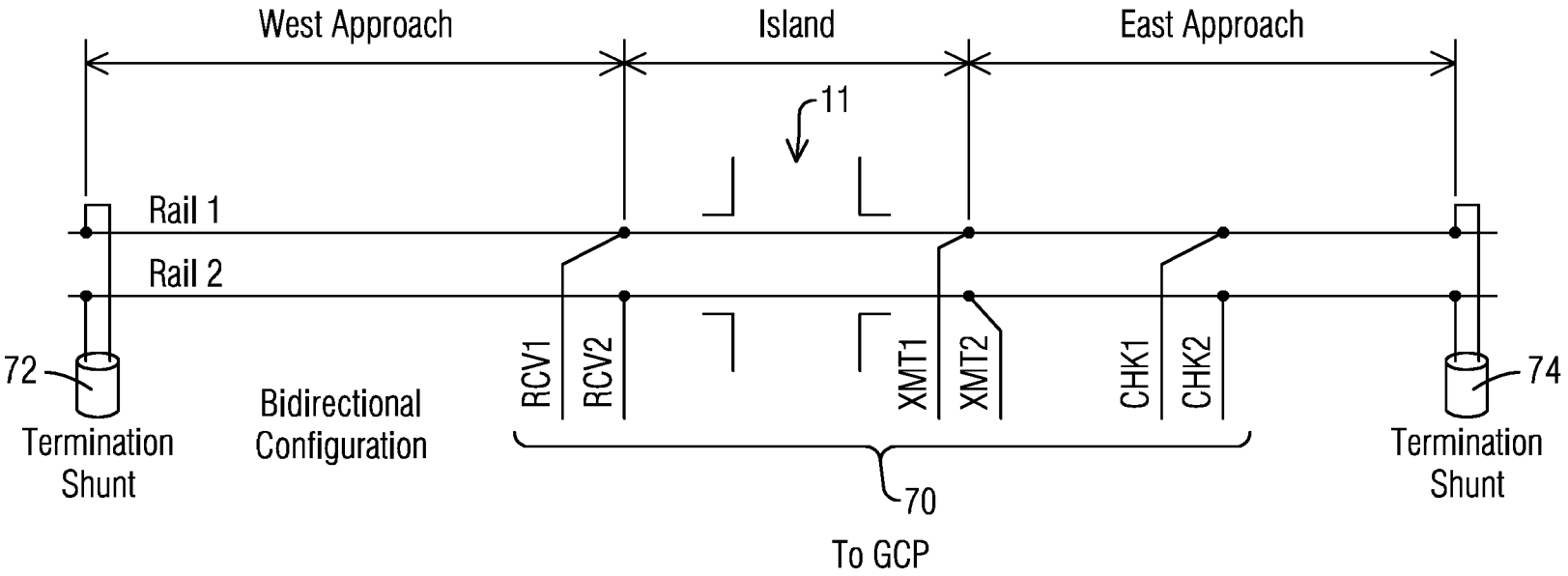
FIG. 5 is a schematic of one nonlimiting embodiment of a multi-wire track connection that may be used in a grade crossing predictor (GCP) to determine train direction, as may be used in disclosed embodiments for automated testing and reporting of timely activation of crossing warning equipment.

FIG. 5 is a schematic of one nonlimiting embodiment of a multi-wire track connection 70 configured to determine train direction that could be used in a grade crossing predictor (GCP) purveyed in commerce by the assignee of the present invention, (Siemens Industry, Inc.) as may be used in disclosed embodiments for automated testing and reporting of timely activation of crossing warning equipment.

As noted above, U.S. Pat. No. 9,630,635 describes system and techniques involving a wayside inspector system that uses physical sensing devices (e.g., magnetometers) installed on the railway tracks to wirelessly detect the presence of a train, and its direction along a given railway track. The embodiment illustrated in FIG. 5 allows detecting the presence of a train, and its direction along the given railway track by way of multi-wire track connection 70 configured to determine train direction. Thus, this embodiment eliminates the use of physical sensing devices (e.g., magnetometers) installed on the railway tracks for determining train direction; and could be used as a backup for any of the embodiments disclosed in the context of FIGS. 1 through 4; such as if, for certain reason/s, the data originated from the real-time train tracking system were to become unavailable.

Consider in one nonlimiting example, a train approaching a crossing 11 from a westerly direction, (labelled West Approach), then presence of the train would be determined by a signal from termination shunt 72 (standard device in an approach to an island circuit in the crossing); and train direction would be determined by the following signal sequence from multi-wire track connection 70: receive wire pair (labelled RCV1 RCV2); then transmit wire pair (labelled XMT1 XMT2)); and ending with check wire pair (labelled CHK1 CHK2).

Conversely, consider in another nonlimiting example, a train approaching crossing 11 from an easterly direction, (labelled East Approach), then presence of the train would be determined by a signal from termination shunt 74 (standard device in the approach to the island circuit in the crossing); and in this case train direction would be determined by the following signal sequence from multi-wire track connection 70: check wire pair (labelled CHK1 CHK2); then transmit wire pair (labelled XMT1 XMT2)); and ending with receive wire pair (labelled RCV1 RCV2).

The wire pairs would be spaced apart at a suitable separation distance from one another, such as without limitation a separation distance in a range from approximately 50 m to approximately 80 m. The multi-wire track connection that generates the signal sequence indicative of train direction is conveyed to the GCP, which in turn conveys this information to the wayside inspector system to perform the automated testing and reporting of timely activation of crossing warning equipment.

In operation, disclosed embodiments offer an innovative technical solution involving no physical sensing devices on the railway tracks effective for automated testing and reporting of timely activation of crossing warning equipment based on data originated from a real-time train tracking system, as may involve onboard train equipment; or, as may be based on a signal sequence from multi-wire track connection configured to determine train direction. Disclosed embodiments provide a cost-effective and reliable solution for automated testing and reporting consistent with applicable regulatory requirements.

While embodiments of the present disclosure have been disclosed in exemplary forms, it will be apparent to those skilled in the art that many modifications, additions, and deletions can be made therein without departing from the scope of the invention and its equivalents, as set forth in the following claims.

What is claimed is:

1. A railroad system comprising:

a wayside inspector system configured for testing and reporting of timely activation crossing warning equipment responsive to data originated from a real-time train tracking system comprising onboard train equipment, the data comprising data indicative of a respective train en route to a respective crossing, the data further indicative of a respective direction of travel on a respective railway track of the respective train en route to the respective crossing, the wayside inspector system comprising:

a processor configured to process the data indicative of the respective train en route to the respective crossing, the processor including a timer configured to measure a time elapsed from activation of crossing warning equipment prior to arrival of the respective train en route to the respective crossing to a time of arrival of the respective train to the respective crossing, and a memory to store a data set configured to uniquely associate the measured elapsed time with the respective crossing including the respective direction of travel on the respective railway track of the respective train en route to the respective crossing, wherein the real-time train tracking system comprises a global positioning system (GPS) and the data comprises data from a centralized data feed of GPS train tracking data of a plurality of trains traveling over a railroad network of railway tracks, the railroad system further comprising a centralized plurality of virtual sensor suites in communication with the centralized data feed of GPS train tracking data, one of the virtual sensor suites of the centralized plurality of virtual sensor suites configured to generate the data indicative of the respective train en route to the respective crossing, further ones of the centralized plurality of virtual sensor suites respectively configured to generate further data indicative of further respective trains en route to further respective crossings.

2. The railroad system of claim 1, wherein each respective sensor suite of the centralized plurality of virtual sensor suites comprises at least two respective virtual sensors, the at least two virtual sensors configured to provide a redundant validity check to the data generated by each respective sensor suite.

3. The railroad system of claim 1, wherein the centralized plurality of virtual sensor suites comprises a cloud-based server.

4. The railroad system of claim 1, further comprising a plurality of respective localized virtual sensor suites in communication with the centralized data feed of GPS train tracking data, one of the virtual sensor suites of the plurality of localized virtual sensor suites configured to generate the data indicative of the train en route to the respective crossing, further ones of the plurality of respective localized virtual sensor suites respectively configured to generate further data indicative of further respective trains en route to further respective crossings.

5. The railroad system of claim 4, wherein each respective sensor suite of the localized plurality of virtual sensor suites comprises at least two respective virtual sensors, the at least two virtual sensors configured to provide a redundant validity check to the data generated by each respective sensor suite of the localized plurality of virtual sensor suites.

6. The railroad system of claim 1, wherein the processor is configured to determine a speed of travel of the respective train en route to the respective crossing, wherein when the speed of travel is at or above a certain threshold speed value, and the measured elapsed time is at or within a predefined tolerance of a threshold warning time value, then the data set is flagged as a data set meeting a warning time requirement associated with the respective direction of travel on the respective railway track for the respective train en route to the respective crossing.

7. The railroad system of claim 6, wherein the control unit is further configured to associate a date and time indicative of when the measured elapsed time was obtained.

8. The railroad system of claim 7, further comprising a back office communication equipment in communication with the wayside inspector system to receive the data set stored in the memory of the wayside inspector system, the back office communication equipment configured to automatically report to a regulation administration data sets meeting the warning side requirement.

9. The railroad system of claim 1, wherein the processor is configured to determine a speed of travel of the respective train en route to the respective crossing, wherein when the speed of travel is at or above a certain threshold speed value, and the measured elapsed time is outside the predefined tolerance of the threshold warning time value, then the data set is flagged as a data set not meeting the warning time requirement associated with the respective direction of travel on the respective railway track for the respective train en route to the respective crossing.

10. The railroad system of claim 9, further comprising a back office communication equipment in communication with the wayside inspector system to receive the data set stored in the memory unit of the wayside inspector system, the back office communication equipment configured to automatically report to a party responsible for the respective crossing data sets not meeting the warning side requirement.

11. The railroad system of claim 1, wherein the processor includes a logic unit to determine whether or not a measurement of time elapsed is to be performed.

12. The railroad system of claim 9, further comprising a grade crossing predictor responsive to a multi-wire track connection configured to generate a signal sequence indicative of the respective direction of travel on the respective railway track of the respective train en route to the respective crossing.

13. The railroad system of claim 12, wherein the grade crossing predictor responsive to the multi-wire track connection indicative of the respective direction of travel on the respective railway track of the respective train en route to the respective crossing constitutes a backup to determine train direction in case the data originated from the real-time train tracking system is not available.

* * * * *